US010137494B2

(12) United States Patent
Sarrazin et al.

(10) Patent No.: US 10,137,494 B2
(45) Date of Patent: Nov. 27, 2018

(54) METHOD FOR OBTAINING A FOUNDRY BODY FROM A GRANULAR MIXTURE COMPRISING A MODIFIED POLYCONDENSED RESIN AND A FORMALDEHYDE SCAVENGER

(71) Applicant: HUTTENES ALBERTUS FRANCE, Brenouille (FR)

(72) Inventors: Stéphane Sarrazin, Ezanville (FR); Manuel Vargas, Pont-Sainte-Maxence (FR); Tung-Fai Lo, Angicourt (FR)

(73) Assignee: HUTTENES ALBERTUS FRANCE, Brenouille (FR)

( * ) Notice: Subject to any disclaimer, the term of this patent is extended or adjusted under 35 U.S.C. 154(b) by 253 days.

(21) Appl. No.: 14/426,930

(22) PCT Filed: Sep. 10, 2013

(86) PCT No.: PCT/FR2013/052077
§ 371 (c)(1),
(2) Date: Mar. 9, 2015

(87) PCT Pub. No.: WO2014/037681
PCT Pub. Date: Mar. 13, 2014

(65) Prior Publication Data

US 2015/0217365 A1 Aug. 6, 2015

(30) Foreign Application Priority Data

Sep. 10, 2012 (FR) ..... 12 58481

(51) Int. Cl.
*B22C 1/02* (2006.01)
*B22C 9/02* (2006.01)
(Continued)

(52) U.S. Cl.
CPC ..... *B22C 1/02* (2013.01); *B22C 1/2246* (2013.01); *B22C 9/02* (2013.01); *B22C 9/123* (2013.01);
(Continued)

(58) Field of Classification Search
CPC ..... B22C 1/00; B22C 1/02
See application file for complete search history.

(56) References Cited

U.S. PATENT DOCUMENTS 9,067,259 B2 * 6/2015 Sarrazin ..... B22C 1/2246
2007/0149644 A1 6/2007 Stancliffe et al.
(Continued)

FOREIGN PATENT DOCUMENTS

CN 101607297 12/2009
EP 2517887 10/2012
(Continued)

*Primary Examiner* — Vickey Nerangis
(74) *Attorney, Agent, or Firm* — Duane Morris LLP; Gregory M. Lefkowitz; Jason M. Nolan

(57) ABSTRACT

The invention relates to a method for manufacturing a foundry body including the preparation of a granular mixture including a polycondensed resin having modified formaldehyde, optionally incorporating an aromatic or polyaromatic during the synthesis thereof, a hardening agent, a formaldehyde sensor compound, water and optionally at least one resin selected from the group comprising tannins, natural polyphenols, and lignins, placing said granular mixture in contact with the surface of a forming tool, and insufflating a flow of gas at 50° C. to 380° C. into the granular mixture for 1 to 300 seconds, in order to ensure at least partial hardening of said mixture. The invention also relates to a method for manufacturing a molded foundry piece made of metal or a metal alloy, which includes pouring metal into at least one body (mold and/or core) thus produced; and to a foundry piece thus manufactured.

18 Claims, 1 Drawing Sheet

(51) Int. Cl.

| | |
|---|---|
| ***B22C 1/22*** | (2006.01) |
| ***B22C 9/12*** | (2006.01) |
| ***B22D 21/04*** | (2006.01) |
| ***C22C 21/00*** | (2006.01) |
| ***C22C 37/00*** | (2006.01) |
| ***C22C 38/00*** | (2006.01) |

(52) U.S. Cl.
CPC ..... *B22D 21/04* (2013.01); *C22C 21/00* (2013.01); *C22C 37/00* (2013.01); *C22C 38/00* (2013.01)

(56) References Cited

U.S. PATENT DOCUMENTS

| | | | |
|---|---|---|---|
| 2012/0123035 | A1 | 5/2012 | Sarrazin et al. |
| 2012/0289651 | A1 | 11/2012 | Kato et al. |

FOREIGN PATENT DOCUMENTS

| | | |
|---|---|---|
| JP | S6478652 | 3/1989 |
| RU | 2353597 | 11/2008 |
| WO | 2004058843 | 7/2004 |
| WO | 2011010045 | 1/2011 |
| WO | 2011078082 | 6/2011 |

* cited by examiner

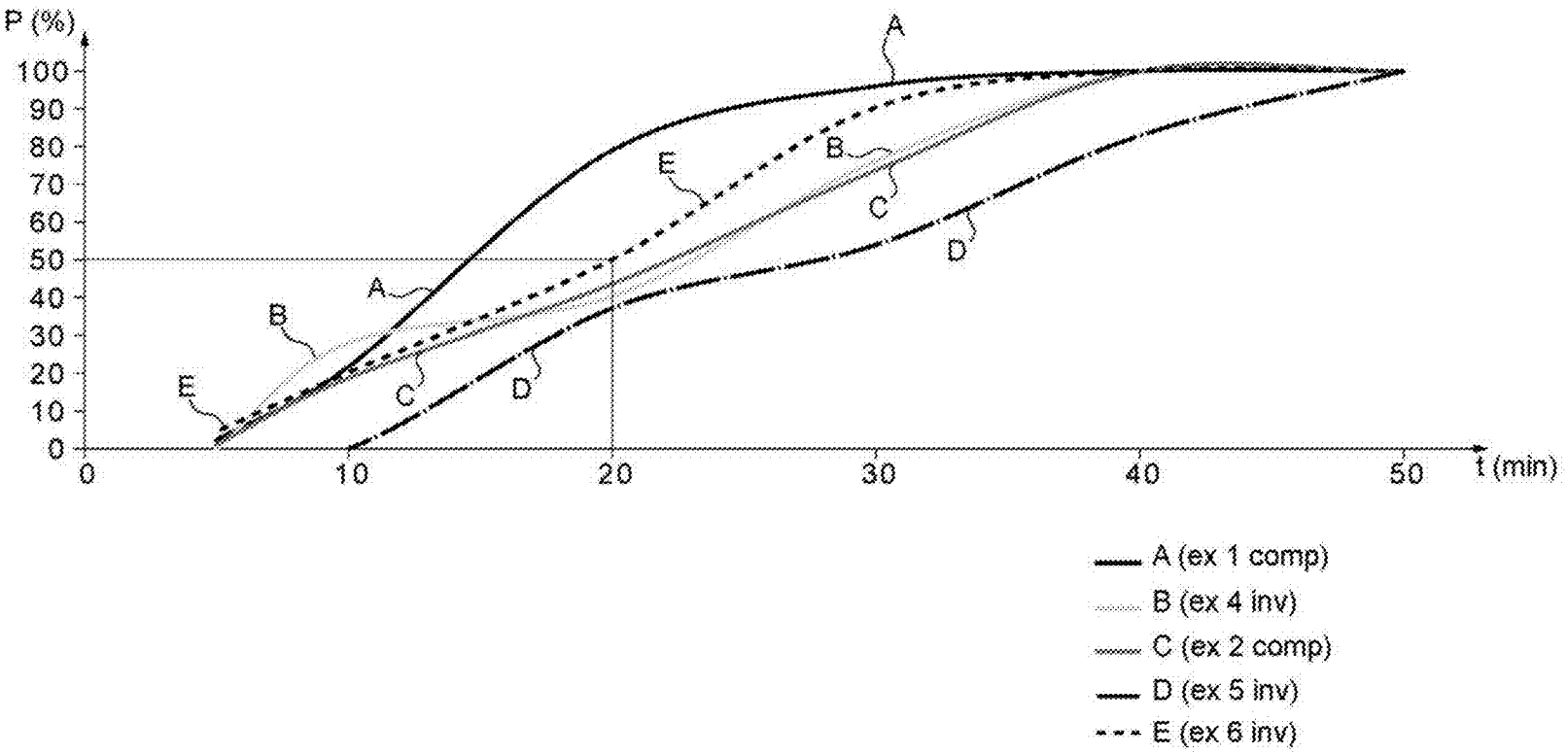
P (%)
100
90
80
70
60
50
40
30
20
10
0
0
10
20
30
40
50
t (min)
A
B
C
D
E
A (ex 1 comp)
B (ex 4 inv)
C (ex 2 comp)
D (ex 5 inv)
E (ex 6 inv)

METHOD FOR OBTAINING A FOUNDRY BODY FROM A GRANULAR MIXTURE COMPRISING A MODIFIED POLYCONDENSED RESIN AND A FORMALDEHYDE SCAVENGER

CROSS-REFERENCE TO RELATED APPLICATIONS

This application is a § 371 national stage entry of International Application No. PCT/FR2013/052077, filed Sep. 10, 2013, which claims priority to French Patent Application No. 1258481, filed Sep. 10, 2012, the entire contents of which are incorporated herein by reference.

BACKGROUND OF THE INVENTION

Field of the Invention

The present invention relates to a method for obtaining a foundry body from a granular mixture comprising a modified polycondensed resin and a formaldehyde scavenger, as well as the foundry body obtained by said method.

Description of the Related Art

Methods for the hot forming of granular or fibrous substances are industrial methods leading to the production of bodies that are usually solid. Among these, the industrial methods of the "hot box" type use resins. Generally, the resins are closely mixed with the substance(s) to be agglomerated, or spread over the surface to be bonded, in combination with a curing agent, the function of which is usually to solidify the reaction medium in situ.

The substances to be formed or agglomerated, generally in solid form, usually contain at least one granular or fibrous filler such as for example mineral or synthetic sands, glass microbeads, ceramic microbeads and fibres that are usually lignocellulosic.

After incorporation of the resin and an optional curing agent, and optionally at least one other additive, the substance to be agglomerated is generally fluid, usually viscous. The substance to be agglomerated is then placed in contact with or in a forming tool, then heated, heat generally being provided by heating the forming or shaping tooling.

The heat causes the resins to cure by polymerization, then the solid body thus formed is generally removed from the forming tool for its subsequent use. By "body" is meant according to the invention a material object occupying a portion of space and having particular properties. The body according to the invention usually consists of a continuous solid medium, i.e. having a substantially invariable structure and volume. Conversely, a fluid body is a generally a body constituting a continuous deformable medium.

One of the industrial methods is known as the "hot box" type and uses resins condensed with formaldehyde. These resins are hot thermoset in an acid medium by polymerization.

In the foundry field, moulds and cores are generally solid bodies that can be produced from a granular filler by a method of the "hot box" type. When each metal part is cast in, or in contact with the mould or core, the corresponding mould or core is destroyed by combustion of the resin on contact with the metal. This means that a mould and core set must be produced for every part made. In order to promote this destruction at industrial production rates and limit the combustion gas pollution, the resin contents, calculated in dry solids, are extremely low, usually comprised within a range from 0.3 to 3% by weight with respect to the mass of granular filler to be agglomerated. Moreover, the chemical nature of the combustion gasses has significance both for the quality of the cast metal parts and for workers' health.

Finally, in certain industrial fields, such as that of mass production in the car industry, moulds and cores must be produced at high rates that can reach several thousand parts per day. In this case, forming tools or core boxes are metal, because the heating temperatures required in order to obtain a rapid polymerization of the resins are high, generally above 150° C., and can reach up to 380° C. This involves significant tooling costs and especially problems of dimensional accuracy of the moulds and cores, associated with the expansion of the tooling under the effect of heat. Furthermore, the respiratory pollutants are considered unacceptable for personnel working in this environment.

For these reasons, over the last forty years or so the industry has turned away from "hot box" type methods in favour of "cold box" type methods. These "cold box" methods offered the use of alternative, cold-set binders, generating in that era a low level of pollution in health and safety terms, and especially compatible with a high industrial production rate.

However, at the present time, these alternative "cold box" type binders themselves also pose a problem in industrial processes, because they have become incompatible with the stricter health and safety and environmental standards.

In this context, the French patent application FR 2948307, published in January 2011, describes an improved method of the "hot box" type, allowing for the problems presented by the "hot box" type methods of the prior art to be solved and overcoming the inadequacies of "cold box" type methods, most particularly in the foundry industry.

Thus, French patent application FR 2948307 relates to a method for producing a body comprising a standard polycondensed resin, preferably a urea-formol resin, and a free formaldehyde scavenger, which is preferably carbohydrazide.

However, this improvement claimed in French patent application FR 2948307 has been found in practice to be usable in industry only in an aluminium foundry. In fact, it has been found to be suitable industrially only for casting parts in aluminium (i.e. at approximately 800° C.). Its thermal resistance is unsuitable for casting parts in a metal alloy such as cast iron, the melting point of which is markedly higher (approximately 1300° C.). Moreover, the nitrogen level generated by the urea-formol resin used in this context has been found to be too significant for the industrial production of a cast iron part.

On the other hand, patent Application US 2007/0149644 also describes the use of tannin extract, in a foundry mix comprising an aggregate and a binder consisting of tannin extract and furfuryl alcohol. This binder does not necessarily contain resin, because the two components of the binder react together at a temperature above 40° C. However, this invention cannot be implemented in industry because furfuryl alcohol is a compound that is currently classified as carcinogenic. Moreover, the foundry mixture of this document apparently does not generate free formaldehyde or free phenol. Thus, according to the text of this document, no formaldehyde scavenger seems necessary in this context. In reality, the presence of free formaldehyde is established and poses a problem, especially the very low reactivity during implementation of this method, which requires heating to a high temperature and/or the use of a powerful catalyst, making it incompatible with large-scale industrial use.

Patent Application WO 2004/058843 describes a composition based on a resin comprising tannin, an amine compound, an aldehyde and a stabilizer. The compound containing amino groups can be urea or an oligomer originating from urea-formaldehyde condensation. The stabilizer is preferably an amino-based heterocyclic compound. A method is also described for preparing this composition, as well as the use of this composition for producing a mixture comprising particles, with the purpose of creating panels from particles, in particular particles of wood. However, the compositions of this document do not comprise a formaldehyde scavenger, since it is explained that the free formaldehyde originating from the resin will react with the tannin during the formation of the composition. In reality, the presence of free formaldehyde is established and poses a problem.

SUMMARY OF THE INVENTION

In the context developed above, the applicant has discovered a method that improves upon the method of patent application FR 2 948 307 previously described. This improved method overcomes the drawbacks of all the methods of the state of the art, especially in the foundry industry, in particular for cast iron.

The present invention relates to a method for producing a body, preferably a casting mould and/or core, said method comprising at least the following successive steps:

preparing a granular mixture, comprising:

a—at least 90%, preferably 96 to 99% by weight of grains, said grains being mainly composed of at least one mineral oxide, and at least 80% of said grains having a size from 10 to 3000 μm, b—0.3 to 3%, preferably 0.6 to 1.5% by weight of at least one resin polycondensed with formaldehyde and/or its derivatives, the percentage being calculated in dry resin solids, c—0.001 to 3%, preferably 0.005 to 1% by weight of at least one curing agent, the percentage being calculated in dry curing agent solids, d—0.003 to 1%, preferably 0.01 to 0.15%, by weight of at least one formaldehyde scavenger compound, and f—0.2 to 3%, preferably 0.7 to 2%, by weight of water;

placing said granular mixture in contact with at least one surface of a forming tool, and blowing at least one gas stream into the granular mixture at a temperature of 50° C. to 380° C., for a duration comprised from 1 to 300 seconds, in order to ensure at least partial curing of said mixture, 0.003% to 1.5%, preferably 0.15% to 1%, by weight of at least one resin chosen from the group consisting of tannins, natural polyphenols and lignins; Said method being characterized in that the polycondensed resin (component b—) of said mixture is modified:

Either by the presence of a component e—in the mixture, at a content from 0.003% to 1.5%, preferably from 0.15% to 1%, by weight with respect to the total weight of the mixture, of at least one resin chosen from the group consisting of tannins, natural polyphenols and lignins, Or by the presence during its synthesis of a compound comprising at least one phenolic and/or polyphenolic unit, at a content from 1 to 30% by weight with respect to the total weight of the polycondensed resin.

It is thus possible according to the invention to modify the resin by one and/or the other of the two options described above: presence of a component e—and/or presence of a compound comprising at least one phenolic and/or polyphenolic unit during the synthesis of the resin. As a minimum, one of the two options must be present, but both options can be present (simultaneously).

Thus, according to the invention, the polycondensed resin with formaldehyde and/or its derivatives (component b—) is modified by the presence of aromatic and/or polyaromatic groups in the mixture.

The polycondensed resin with formaldehyde and/or its derivatives (component b—) is preferably a furanic resin, an aminoplast, a phenoplast or a copolymer of at least two of these three compounds.

The formaldehyde scavenger (component d—) is generally according to the invention a compound of the hydrazide family, preferably chosen from the group consisting of the mono- and dihydrazides, said scavenger being even more preferably adipic acid dihydrazide, succinic acid dihydrazide or carbohydrazide. Particularly preferably, the formaldehyde scavenger is carbohydrazide.

The resin chosen from the group consisting of tannins, natural polyphenols and lignins (component e—) is preferably a resin of the tannin type, even more preferably a resin of the condensed tannin type.

In the case in point, the component e) is a resin on its own, and is generally added to component b) in a pre-mix (as a diluent if the two components are liquids). Its presence modifies the behaviour of the polycondensed resin (component b), which is therefore a "modified" resin when implemented) in the mixture during implementation of the method according to the invention.

BRIEF DESCRIPTION OF THE DRAWINGS

FIG. 1 depicts curves for five different resins subjected to a disintegration test, as described herein.

DETAILED DESCRIPTION OF THE INVENTION

According to the invention, it is possible to add components b), c) d) and f), and optionally e), to component a) separately (i.e. each component b), c) d) and f), and optionally e), is added one by one to component a), or by using at least one premix. Thus, it is possible to produce a premix of components b) and e); or b), e) and f); or c) and e); or c), e) and f); or d) and e); or d), e) and f); or b) and f); or b), c) and f); or b) c) d) and f); then to mix this premix with at least component a). Moreover, component f), which is water, can be incorporated in advance, wholly or partially, with at least one of the other components.

The blowing step makes it possible to implement at least partially at least one chemical reaction that ensures at least partial curing of said mixture.

As known to a person skilled in the art, these steps are generally followed by removing the substantially solid body from the forming tool.

Particularly advantageously, the method according to the invention allows particularly, in the case of use of the body thus obtained for founding cast-iron parts, to reduce the production of formaldehyde during the reaction, to reduce the level of nitrogen generated in the formed body, to enrich the formed body in carbon and to improve the thermal resistance during the method.

Of course, the granular mixture can contain any other additive known to a person skilled in the art. In particular the granular mixture can contain any liquid or powder additive known to a person skilled in the art, for promoting the physicochemical behaviour of the mixture during its conversion and subsequent use.

The grains (particles) of the granular mixture according to the invention are generally natural or synthetic. Preferably, the grains are mineral oxide grain(s), usually natural silica sand mixtures, the grains of which mainly consist of silica oxide and the AFS (American Foundry Society) grain size number of which can range from 30 to 140.

Water is generally added to the granular mixture mainly as a solvent of components b) to d), optionally e), of the granular mixture.

Inasmuch as the curing agent is generally incorporated into the granular mixture at a very low ratio, it is better dispersed if it is diluted in advance in an aqueous solution. The same applies for the formaldehyde scavenger and for the optional component e), if the latter is supplied in powder form.

The granular mixture according to the invention is generally in the form of at least one fluid aggregate.

The surface of the forming tool with which the granular mixture is in contact generally represents the "negative" of the part to be formed in the body produced according to the invention.

The step of blowing a hot gas stream is generally such that the temperature and the flow rate of said stream are adjusted in order to cause the temperature to rise at the heart of the granular mixture, substantially above ambient temperature (which is approximately 20° C.) and preferably above 45° C.

The method according to the invention, by the presence in the granular mixture of at least one formaldehyde scavenger and of a modified polycondensed resin, advantageously makes it possible to significantly improve the thermal properties of the granular mixture and to limit the emission of free formaldehyde during the production of the formed bodies. Moreover, the presence of a modified polycondensed resin makes it possible to significantly improve the thermal properties, and to reduce the nitrogen level, of the formed bodies. These features make the use of the body thus obtained particularly advantageous for casting cast iron parts and in particular adaptable to mass production foundry work.

Preferably, the method according to the invention is such that, moreover, the forming tool is heated to a temperature comprised within a range from 40 to 180° C., preferably from 50 to 150° C. This is generally carried out as early as the contact step, and at the latest during the blowing step.

Thus, the heat provided by the hot gas is supplemented by the heat from heating the forming tool, so that in a preferred version of the invention, heating of the granular mixture is optimized.

The gas is preferably chosen from the group consisting of air, an inert gas and a gas contributing to the acidification of the reaction medium.

By "inert gas", is meant according to the invention a gas that does not contribute to the reaction, for example chosen from dinitrogen and the so-called noble gasses such as helium, neon and argon. By "gas contributing to the acidification of the reaction medium", is meant according to the invention a gas making it possible to reduce the pH of the medium in situ, such as carbon dioxide or sulphur dioxide.

In a preferred embodiment of the invention, the method contains moreover an additional step, during which a stream of at least one gas is circulated within the at least partially cured granular mixture, at a temperature comprised within a range from 5° C. to 45° C., for a duration comprised within a range from 1 to 300 seconds, the gas being preferably chosen from the group consisting of air, dinitrogen and carbon dioxide. This step is usually carried out before the optional step of removing the body from the forming tool. The gas is usually not pre-heated, and therefore substantially at ambient temperature, or even possibly cooled.

As formaldehyde pollution can occur after production of the body, during its storage or subsequent handling, it proves very beneficial and advantageous within the context of the invention to supplement the formaldehyde scavenger activity by blocking the polymerization reaction of the modified polycondensed resin, by cooling the body after its partial curing. Moreover, the gas stream advantageously allows any remaining free formaldehyde to be washed away by a stream of air, dinitrogen or carbon dioxide.

By polycondensed resin or resin polycondensed with formaldehyde and/or its derivatives is meant a composition of at least one resin having undergone a chemical reaction between a first element chosen from urea and its derivatives, melamine, benzoguanamine, glycoluril, phenol and/or its derivatives and furfuryl alcohol and/or its derivatives, and a second element chosen from formaldehyde and/or its derivatives, in which preferably the chain growth generally causes the release of a water molecule at each stage.

This polycondensed resin is generally a thermosetting polymer, such as a furanic resin or an aminoplast or a phenoplast or a copolymer of these compounds, preferably an aminoplast or a phenoplast or an aminoplast-phenoplast copolymer.

The aminoplasts are obtained by polycondensation of the first comonomer, which is formaldehyde, and the second comonomer bearing amino groups ($NH_2$—). They are generally divided into two main families of compounds, namely urea-formaldehyde (or urea-formol) resins (abbreviation UF) and melamine-formaldehyde (or melamine-formol) (abbreviation MF).

The phenoplasts or phenol-formaldehyde resins (abbreviation PF) are obtained by polycondensation between a first comonomer, which is formaldehyde, and a second comonomer, which is phenol. Two types of phenoplasts are distinguished: novolacs, prepared by acid catalysis, and resols, obtained by basic catalysis. The best known phenoplast is Bakelite® (or polyoxybenzylmethyleneglycol anhydride), which is the oldest industrial synthetic polymer material.

Furanic resin is obtained by polycondensation of the first comonomer, which is furfuryl alcohol and of the second comonomer, which is formaldehyde.

Excess free constituent(s) of the polycondensed resin can remain in the polycondensed resin, or also were added to it after polycondensation.

The resin polycondensed with formaldehyde and/or its derivatives is generally such that it heat cures in an acid medium. Such a resin is generally commercially available.

The polycondensed resin can, according to the invention, be modified by the presence during its synthesis of a compound comprising at least one phenolic and/or polyphenolic unit, at a content from 1 to 30% by weight, preferably from 5 to 20% by weight, with respect to the total weight of the modified polycondensed resin. This is therefore not the polycondensed resin described in French patent application FR 2948307. In fact, it comprises groups which are derivatives of the precursor groups, which are the phenolic and/or polyphenolic units, preferably present in a compound such as vanillin and phloroglucinol. This compound is generally mixed with the resin before its synthesis and the derivative groups "become attached" to the resin during its synthesis.

The polycondensed resin can thus have been premixed with a compound, most often synthetic, such as vanillin or phloroglucinol. In this case, the presence in the granular mixture used in the method according to the invention of a component e) according to the invention, i.e. the resin chosen from the group consisting of tannins, natural polyphenols and lignins, is optional.

The phenolic and/or polyphenolic unit can be of natural or synthetic origin. The resin is thus in the form of a formophenolic copolymer. Within the context of this embodiment, it is particularly preferred for the phenolic and/or polyphenolic unit to be present in a compound chosen from the group consisting of vanillin (4-hydroxy-3-methoxybenzaldehyde) and phloroglucinol (benzene-1,3,5-triol).

The resin polycondensed with formaldehyde and/or its derivatives according to the invention can moreover optionally contain at least one additive chosen from the solvents, diluents, stabilizers and solid particle fillers usually used, and known to a person skilled in the art, in order to obtain a particular effect. Thus, said resin can contain at least one silane, which generally allows the bond between the resin and the grains to be bridged, and thus optimized.

The resin chosen from the group consisting of tannins, natural polyphenols and lignins, is a natural polymer rich in aromatic nuclei (i.e. comprising at least two aromatic rings). In reality, this resin contains at least one aromatic ring per monomer unit of the polymer, therefore a plurality of aromatic rings. This resin is chosen according to the invention from the group consisting of the tannins, which are generally of natural origin, preferably condensed and/or modified in order to render them soluble in water, such as extracts of the Quebracho tree, natural polyphenols such as those extracted from *araucaria angustifolia* (Paraná pine) or from *pinus palustris* (longleaf pine), and lignins, modified or not.

The resin chosen from the group consisting of tannins, natural polyphenols and lignins, is most often renewable. By renewable resin is meant according to the invention either a natural resin the stock of which can be reconstituted over a short period on the human scale, or a synthetic resin the main starting materials for synthesis of which are renewable constituents; in theory the renewal must take place at least as quickly as the consumption.

In a preferred embodiment, the resin chosen from the group consisting of tannins, natural polyphenols and lignins is a resin of the tannin type, and even more preferably this is a resin of the condensed tannin type.

The resin of the tannin type is usually a natural phenolic substance. This is generally a secondary metabolite of a higher plant that is found in practically all parts of the plants (bark, roots, leaves, stems, etc). Tannins are natural polyphenolic resins, either of polyols of the monosaccharide type and galloyl units or their derivatives, linked to flavonoids or triterpenoids, or oligomers or polymers of flavonols. Preferably the tannins used according to the invention are polyflavonoids, for example of the Quebracho tree tannin type.

The lignins are polymers based on one or more monolignols, such as paracoumarylic alcohol, coniferylic alcohol and sinapylic alcohol. The lignins can for example be lignosulphonates modified by reactions with bisulphites.

The resin chosen from the group consisting of tannins, natural polyphenols and lignins can also be a thermoplastic resin, for example, an extract of *araucaria angustifolia* (Paraná pine) or of *pinus palustris* (longleaf pine).

The resin chosen from the group consisting of tannins, natural polyphenols and lignins can be composed of long-chain aliphatic phenols such as an extract of the shell of cashew nuts.

Thus, the resin chosen from the group consisting of tannins, natural polyphenols and lignins can be a commercial compound such as the following commercial products: Respine RLP from the company POLYTRADE (natural aromatic resin originating from *araucaria angustifolia*); VINSOL® from the company HERCULES (composed of approximately 57% polyphenols, 28% colophanes and 15% terpenoids); QSF (alcohol-soluble part of Quebracho tannins), FINTAN 737B (modified condensed tannin originating from *Schinopsis lorentzii* or powdered Quebracho colorado) and FINTAN 737C (stabilized condensed tannin originating from *Schinopsis lorentzii* or Quebracho colorado in solution at 45%) from the company INDUNOR; and CARDANOL (aliphatic long chain phenols originating from cashew nut shells) from the company SAI CHEMICALS.

The curing agent is generally chosen from the group consisting of the following compounds:

- naturally acid salts such as ammonium salts, in particular persulphates, nitrates, bisulphates, sulphates and chlorides;
- salts generating an acid by reaction with an aldehyde, such as hydroxylamine salts, in particular hydroxylamine sulphates, hydrochlorides, phosphates, sulphonates and nitrates;
- sublimable acids, in particular oxalic acid and benzoic acid; and, optionally,
- organic acids compatible with the method with the regard to their reactivity and their toxicity, such as for example lactic acid and citric acid.

The curing agent is more generally such that it renders the reaction medium of the mixture acidic, either by its innate acidity, or by its capacity to release acid during the polymerization process.

Particularly preferably, the curing agent is chosen from the group consisting of hydroxylamine salts, and even more preferably, the curing agent is hydroxylamine sulphate. The hydroxylamine salts advantageously release an acid in the presence of formaldehyde.

In the preferred embodiment where the curing agent is a hydroxylamine salt, it appears surprisingly according to the invention that the available free formaldehyde combines as a priority with this hydroxylamine salt to release an acid, and that the formaldehyde scavenger only inhibits the formation of acid by said salt to a minor extent, or not at all, during the curing reaction.

Moreover, the applicant has found that the use of a hydroxylamine salt significantly and advantageously improves the method according to the invention, by accelerating the kinetics of curing and by increasing the acidity of the reaction medium as the curing reaction releases formaldehyde.

Moreover, the addition of the formaldehyde scavenger substantially improves the mechanical characteristics of the formed bodies.

A person skilled in the art is able to choose resins b) and e) as well as the curing agent that are suitable for the case in hand, taking into account in particular the reactivity of the binder system, i.e. the resin(s) and curing agent(s) incorporated in the granular mixture.

Producing the granular mixture according to the first step of the method of the invention is generally carried out in a manner known to a person skilled in the art. Thus, in standard fashion, with the usual mixing equipment available, a person skilled in the art first places the granular portion(s) in a mixer, followed by the liquid portion(s), the mixing time depending on the equipment, and preferably from 15 s to 5 min.

The method relates most particularly to a method for the production of a cast metal, or metal alloy, foundry piece, which comprises pouring a liquid metal or metal alloy into at least one mould and/or core, characterized in that said mould is a body obtained by the method according to the invention as previously described.

Preferably, such a method is such that the metal, or metal alloy, is chosen from the group consisting of aluminium, ferrous alloys chosen from the group consisting of steels and cast irons, non-ferrous metals, non-ferrous alloys, and more preferably, the metal or metal alloy is chosen from the group consisting of cast irons.

The invention also relates to any cast part obtained by a production method as previously described. The invention relates moreover to any mechanical assembly containing at least one such piece.

The invention is illustrated by the attached FIG. 1, which is described in the examples hereinafter.

FIG. 1 represents curves A, B, C, D and E of the passing fraction P (as a percentage) as a function of the time t (in minutes) for five different resins described in the examples, i.e. each curve represents the passing fraction percentage as a function of time for the resin concerned. This makes it possible to assess the thermal resistance thereof.

The invention will be better understood in the light of the following examples which illustrate the invention non-limitatively.

EXAMPLES

The following examples were produced each time by mixing 4 kg of SIFRACO LA 32 silica sand with the other components in the proportions indicated for each granular mixture.

For each example, a premix was produced mainly comprising the polycondensed resin (component b)) and optionally a resin chosen from the group consisting of tannins, natural polyphenols and lignins (component e)), and a second premix was produced comprising the curing agent (component c)) and optionally a formaldehyde scavenger compound (component d)). Water was generally present in these two premixes. Then, the granular mixture was made by mixing the silica sand, the first premix and the second premix. The granular mixture was made in a mixer with a vibrating bowl with a mixing time of 60 seconds. The granular mixture was then blown into a box equipped with a heating system and a hot air intake (at 100-120° C.), under a pressure of 1.5 bar (0.15 MPa), for a duration of 60 seconds, containing two test samples for measuring standardized mechanical characteristics having square cross-section of 5 $cm^2$, on a ROPER machine.

The curing was carried out according to the data given for each granular mixture.

The measurement of the formaldehyde on mixing was carried out by a DRAGER model Accuro pump equipped with DRAGER formaldehyde detection tubes (0.2/a). The range of measurement is from 0.2 to 5 ppm. The measurements were carried out above the vibrating bowl of the mixer.

The measurement of the formaldehyde on removal from the box was carried out by the DRAGER model Accuro pump equipped with DRAGER formaldehyde detection tubes (0.2/a or 2/a), according to the concentration to be measured in a 10-liter enclosure in which a nitrogen stream of 0.5 L/min circulates. A test tube was placed in the enclosure immediately on removal from the box. The detection tube was used for measuring the formaldehyde in the air of the enclosure for 180 seconds. The results are given as they are for the tube 0.2/a (n=20 pump strokes), and are multiplied by 4 for the tube 2/a (n=5 pump strokes). All incorporation rates are percentages by weight.

The bending measurements were carried out according to the B.N.I.F. technical recommendations n° 481 and 487 of December 1999 published by and available from the Centre Technique des Industries de la Fonderie in Sevres, France. The results are expressed in daN/$cm^2$.

It is considered that bending strengths of approximately 10 daN/$cm^2$ when hot on removal from the box are sufficient to allow handling of the formed bodies, and that strengths of approximately 30 daN/$cm^2$ when cold, i.e. one hour after leaving the box are often satisfactory to allow the metal to be cast.

The bending strengths were measured in both the hot and cold condition, after a curing time of 15 seconds, 30 seconds, 60 seconds and 120 seconds in the box.

The detection at the end of removal (or extraction) from the box of a (free) formaldehyde content of more than 20 times less than the conventional hot box method is considered to render the formed body suitable for an industrial use.

The dry solid expressed in % by weight is the residual product after heating one gram of product at 135° C. for one hour.

The test pieces obtained are solid formed bodies that can be likened to cores.

The disintegration rate of the granular body at 450° C. was measured under the following conditions:

- Moulded bodies having a parallelepipedic shape of square cross-section of 5 $cm^2$ were produced. The moulded bodies were then left to stand for 24 hours. Within these moulded bodies, cubes adjusted to 23.5 g (±0.5 g) per cube were produced, leaving the extremities of the moulded bodies unused.
- The cubes were placed separately in crucibles closed by a cover. The crucibles were labelled.
- The crucibles were then placed in a muffle furnace set to 450° C., a timer having been started on closing the furnace.
- The crucibles were removed from the furnace at regular intervals (for example 5-10-20-30-40 minutes, etc.) then allowed to cool at ambient temperature.
- The contents of each crucible was then placed on a 1 mm mesh sieve, and subjected to the vibration of a Retsch VS1000 laboratory sieve shaker for 30 seconds.
- The passing fraction was recovered, weighed and the mass obtained was converted into a percentage.

This measurement, which is representative of the heat resistance of the polycondensed resin, is given on the attached curve (FIG. 1) which illustrates the passing fraction P (as a percentage) of the formed body passing through the sieve as a function of the residence time t (in minutes) in the furnace for five different example resins. The respective curves of these five resins are curves A, B, C, D and E present on the diagram of FIG. 1 which shows the thermal resistance of five of the example resins.

It is estimated that a percentage of formed bodies passing through the sieve, under the test conditions of less than 50% after twenty minutes, allows cast-iron parts to be cast.

Example 1 (Comparative)

Resin: Urea-formaldehyde resin, Cleantech 11R26 commercial product, synthesized in an acid medium with a formaldehyde/urea molar ratio of 2.37 (used at 2.0% with respect to the sand)

Catalyst: Cleantech 14D38 commercial product from the company Hüttenes Albertus France containing 3% hydroxylamine sulphate, 15% carbohydrazide and 82% water (used at 0.4% with respect to the sand)
Box Temperature: 130° C.
Hot air temperature: 100-120° C.
Hot bending strength on removal from box: respectively at 30, 60 and 120 seconds: 18, 32 and 55 daN/cm$^2$
Cold bending strength, respectively at 30, 60 and 120 seconds: 72, 80 and 72 daN/cm$^2$
The hot and cold bending strengths are sufficient to allow, respectively, handling of the formed bodies and casting of the metal.
Formaldehyde on mixing: less than 0.2 ppm (not detectable)
Formaldehyde on removal from the box: comparative value 0.2
The formaldehyde emissions on mixing and removal from the box are extremely low (with removal from the box, approximately 600 times lower than the hot-box method represented by Example 3).
% passing fraction (P) at 20 minutes: 79% (see Curve A of FIG. 1)
The thermal resistance, expressed by this percentage, is incompatible with casting cast-iron foundry pieces.

Example 2 (Comparative)

Resin: Urea-melamine/formaldehyde resin referenced FUM274 synthesized with a formaldehyde/urea molar ratio of 2.95 and a formaldehyde/melamine molar ratio of 3.45 (used at 2% with respect to the sand)
Catalyst: reference UFAC 12/268 containing (20%) hydroxylamine sulphate and (80%) water (used at 0.4% with respect to the sand)
Box Temperature: 120° C.
Hot air temperature: 100-120° C.
Hot bending strength on removal from the box: respectively at 30, 60 and 120 seconds: 17, 24 and 44 daN/cm$^2$
Cold bending strength, respectively at 30, 60 and 120 seconds: 72, 70 and 53 daN/cm$^2$
Formaldehyde on mixing: 1 ppm
The hot and cold bending strengths are sufficient to allow, respectively, handling of the formed bodies and casting of the metal.
Formaldehyde on removal from the box: comparative value 80
The formaldehyde emissions on mixing and removal from the box are high and
present a problem.
% passing fraction (P) at 20 minutes: 37% (see curve C of FIG. 1)
The thermal resistance, expressed by this percentage, is sufficient for casting cast-iron foundry pieces.

Example 3 (Comparative)

Resin: Urea-phenol/formaldehyde resin, Résital 12662 commercial product from the company Hüttenes Albertus France.
This resin is characteristic of the "hot box" method, and was used at 2% with respect to the sand.
Catalyst: Harter AT3B commercial product from the company HOttenes Albertus France (magnesium lignosulphonate in solution at 50%), urea and ammonium nitrate.
This catalyst was used at 0.5% with respect to the sand.
This resin is characteristic of the "hot box" method used in cast iron foundry work.
Box Temperature: 220° C.
Hot bending Strength on removal from the box: respectively at 30, 60 and 120 seconds: 34, 51 and 61 daN/cm2
Cold bending resistance, respectively at 30, 60 and 120 seconds: 70, 70 and 59 daN/cm$^2$
The hot and cold bending strengths are sufficient to allow, respectively, handling of the formed bodies and casting of the metal.
Formaldehyde on mixing: 1 ppm
Formaldehyde on removal from the box: comparative value 120
The formaldehyde emissions on mixing and removal from the box are incompatible with the development of health and safety standards.

Example 4 (According to the Invention)

Resin: Urea—formaldehyde resin comprising vanillin, which was synthesized in an acid medium with a formaldehyde/urea molar ratio of 2.37, and to which vanillin was added in a urea/vanillin molar ratio of 4.5.
The vanillin content with respect to the resin is 11.3% by weight.
This resin was used at 2% with respect to the sand.
Catalyst: Catalyst constituted by 1.4% hydroxylamine in solution at 50%, 1.7% p-toluene sulphonic acid in solution at 65%, 15.1% carbohydrazide, 2.2% hydroxylamine sulphate and 79.7% water.
This catalyst was used at 0.4% with respect to the sand.
Box Temperature: 120° C.
Hot air temperature: 100-120° C.
Hot bending strength on removal from the box: respectively at 30, 60 and 120 seconds: 15, 30 and 45 daN/cm$^2$
Cold bending resistance, respectively at 30, 60 and 120 seconds: 55, 60 and 65 daN/cm$^2$
The hot and cold bending strengths are sufficient to allow, respectively, handling of the formed bodies and casting of the metal.
Formaldehyde on mixing: less than 0.2 ppm (not detectable)
Formaldehyde on removal from the box: comparative value 2.5
The formaldehyde emissions on mixing and removal from the box are low (on removal from the box, approximately 50 times lower than the hot-box method represented by Example 3).
% passing fraction (P) at 20 minutes: 43% (see Curve B of FIG. 1)
The thermal resistance, expressed by this percentage, is considered to be sufficient for casting cast-iron foundry pieces.

Example 5 (According to the Invention)

Resin: Urea-melamine/formaldehyde resin, which was synthesized with a formaldehyde/urea molar ratio of 2.95 and to which melamine was added in a formaldehyde/melamine molar ratio of 3.45 then to which was added 3% Fintan 737B modified tannin, a commercial product from the company Indunor (modified condensed tannin originating from *Schinopsis lorentzii* or Quebracho colorado in powder).
This resin was used at 2.2% with respect to the sand.
Catalyst: Catalyst containing 14% hydroxylamine sulphate, 20% carbohydrazide and 66% water.
This catalyst was used at 0.3% with respect to the sand.
Box Temperature: 130° C.
Hot air temperature: 100-120° C.

Hot bending strength on removal from the box: respectively at 30, 60 and 120 seconds: 15, 24 and 42 daN/cm$^2$ Cold bending resistance, respectively at 30, 60 and 120 seconds: 75, 84 and 95 daN/cm$^2$ The hot and cold bending strengths are sufficient to allow, respectively, handling of the formed bodies and casting of the metal.

Formaldehyde on mixing: less than 0.2 ppm (not detectable)

Formaldehyde on removal from the box: comparative value 2.5

The formaldehyde emissions on mixing and removal from the box are low (on removal from the box, approximately 50 times lower than the hot-box method represented by Example 3).

% passing fraction (P) at 20 minutes: 40% (see Curve D of FIG. 1)

The thermal resistance, expressed by this percentage, is considered to be sufficient for casting cast-iron foundry pieces.

Example 6 (According to the Invention)

Resin: Urea/formaldehyde modified tannin, which was synthesized with a formaldehyde/urea molar ratio of 2.37, and to which was added 25% Fintan 737C modified tannin, a commercial product from the company Indunor (stabilized condensed tannin originating from *Schinopsis lorentzii* or Quebracho colorado in solution at 45%).

This resin was used at 2% with respect to the sand.

Catalyst: Catalyst containing 14% hydroxylamine sulphate, 20% carbohydrazide and 66% water.

This catalyst was used at 0.3% with respect to the sand.

Box Temperature: 130° C.

Hot air temperature: 100-120° C.

Hot bending strength on removal from the box: respectively at 15, 30 and 60 seconds: 6, 13 and 21 daN/cm$^2$ Cold bending resistance, respectively at 15, 30 and 60 seconds: 31, 40 and 45 daN/cm$^2$ The hot and cold bending strengths are sufficient to allow, respectively, handling of the formed bodies and casting of the metal.

Formaldehyde on mixing: less than 0.2 ppm (undetectable)

Formaldehyde on removal from the box: comparative value 2.5

The formaldehyde emissions on mixing and removal from the box are low (on removal from the box, approximately 50 times lower than the hot-box method represented by Example 3).

% passing fraction (P) at 20 minutes: 50% (see Curve E on FIG. 1)

The thermal resistance, expressed by this percentage, is considered to be sufficient for casting cast-iron foundry pieces.

The invention claimed is:

1. Method for producing a foundry body, comprising at least the following successive steps:

preparing a granular mixture, comprising, in % weight with respect to the total weight of the mixture:

a—at least 90%, by weight of grains, said grains being mainly composed of at least one mineral oxide, and at least 80% of said grains having a size from 10 to 3000 μm, b—0.3 to 3%, by weight of at least one resin polycondensed with formaldehyde and/or its derivatives, the percentage being calculated in dry resin solids, c—0.001 to 3%, by weight of at least one curing agent, the percentage being calculated in dry curing agent solids, d—0.003 to 1%, by weight of at least one formaldehyde scavenger compound, and f—0.2 to 3%, by weight of water;

placing said granular mixture in contact with at least one surface of a forming tool, and blowing at least one gas stream into the granular mixture at a temperature of 50° C. to 380° C., for a duration comprised from 1 to 300 seconds, in order to ensure at least partial curing of said mixture, wherein said at least one resin has undergone a chemical reaction between a first element chosen from urea and its derivatives, melamine, benzoguanamine, glycoluril, and a second element chosen from formaldehyde and/or its derivatives, wherein the polycondensed resin (component b—) of said granular mixture is modified by the presence of a component e—in the mixture, at a content from 0.003% to 1.5%, by weight with respect to the total weight of the mixture, said component e—being at least one resin, wherein said at least one resin comprises tannins; and wherein the foundry body disintegrates 50% or less after 20 minutes at 450° C.

2. Method according to claim 1, wherein the formaldehyde scavenger (component d—) is a compound of the hydrazide family.

3. Method according to claim 1, wherein the forming tool is heated to a temperature comprised within a range from 40 to 180° C.

4. Method according to claim 1, comprising an additional step, during which a stream of at least one gas is circulated within the at least partially cured granular mixture, at a temperature comprised within a range from 5° C. to 45° C., for a duration comprised within a range from 1 to 300 seconds.

5. Method according to claim 1, wherein said gas is chosen from the group consisting of air, an inert gas and a gas contributing to the acidification of said mixture.

6. Method according to claim 4, wherein the gas is chosen from the group consisting of air, dinitrogen and carbon dioxide.

7. Method according to claim 1, wherein the tannins are condensed and/or modified tannins.

8. Method according to claim 1, wherein the curing agent is chosen from the group consisting of the following compounds:

naturally acid salts;

salts generating an acid by reaction with an aldehyde;

sublimable acids; and, organic acids compatible with the method with the regard to their reactivity and their toxicity.

9. Method according to claim 8, wherein the curing agent is a hydroxylamine salt.

10. Method according to claim 1, wherein the formaldehyde scavenger (component d—) is a monohydrazide or a dihydrazide.

11. Method according to claim 1, wherein the formaldehyde scavenger (component d—) is a compound of the hydrazide family chosen from the group consisting of the adipic acid dihydrazide, succinic acid dihydrazide and carbohydrazide.

12. Method according claim 1, wherein the tannin is a condensed tannin.

13. Method according to claim 1, wherein the forming tool is heated to a temperature within a range from 50 to 150° C.

14. Method according to claim 1, wherein the polycondensed resin with formaldehyde and/or its derivatives (component b—) is a urea-formaldehyde resin.

15. Method according to claim 1, wherein the at least one polycondensed resin with formaldehyde and/or its derivatives (component b—) comprises a urea-formaldehyde resin.

16. Method according to claim 1, wherein said at least one resin further comprises natural polyphenols or lignins.

17. Method according to claim 1, wherein the step of preparing a granular mixture comprises, in sequence:

providing a first premix comprising the polycondensed resin (component b—), the resin comprising tannins (component e—), and optionally the water (component f—);

providing a second premix comprising the curing agent (component c—), the formaldehyde scavenger compound (component d—), and optionally the water (component f—) to obtain a second premix; and mixing the first premix, the second premix, and the grains (component a—) to obtain the granular mixture.

18. Method according to claim 1, wherein the foundry body is for casting a ferrous alloy.

* * * * *